US006170716B1

(12) United States Patent
Chen

(10) Patent No.: US 6,170,716 B1
(45) Date of Patent: Jan. 9, 2001

(54) OIL CAN STRUCTURE

(76) Inventor: Chung Ming Chen, 7F-1, No.245, Sec.3., Roosevelt Road, Taipei (TW)

( * ) Notice: Under 35 U.S.C. 154(b), the term of this patent shall be extended for 0 days.

(21) Appl. No.: 09/443,893

(22) Filed: Nov. 19, 1999

(51) Int. Cl.[7] ..... B65D 83/00
(52) U.S. Cl. ..... 222/401; 222/400.8
(58) Field of Search ..... 222/400.8, 401

(56) References Cited

U.S. PATENT DOCUMENTS 5,020,696 * 6/1991 Cater ..... 222/401
5,323,935 * 6/1994 Gosselin et al. ..... 222/401
5,385,276 * 1/1995 Yen-Tang ..... 222/400.8

* cited by examiner

*Primary Examiner*—Philippe Derakshani
*Assistant Examiner*—Thach Bui
(74) *Attorney, Agent, or Firm*—Dougherty & Troxell

(57) ABSTRACT

An oil can structure comprises an upper cover, a lock head, a jetting seat, a body, a lower seat, a piston, a sliding barrel and a rotary seat. Thereby, the oil can is operated easily and conveniently with less power and labor hour. The body receiving high pressure air and oil has an outer thread and an inner thread at the upper and lower inner side thereof. The outer thread has a jetting seat with a tube. The jetting seat has a jetting hole for jetting oil and air. Moreover, a lock head is installed at an outer cover of the jetting seat; the locking head has an inner thread for being screwedly engaged with the outer thread at the upper side of the body. A lower seat with an O ring, an outer thread, and an elastic hook is installed at the body. A post with vent and enclosed by a plastic cover is installed at the center of the lower seat. An inner barrel and strips are formed at the lower inner side and lateral side thereof. A sliding barrel with a positioning groove is installed within the inner barrel. The sliding barrel is installed with a big tooth at the inner lower side thereof and has a table having a rotary seat which can be engaged with the elastic hook of the lower seat. The center thereof has a stud for being engaged with the inner thread of the sliding barrel. By bidirectional rotation of the rotary seat at the lower seat, a piston installed at the inner barrel of the lower seat slides upwards and downwards so that air will be compressed into the body to have a high pressure. Therefore, as the jetting seat is pressed, oil and air will jet out together.

1 Claim, 8 Drawing Sheets

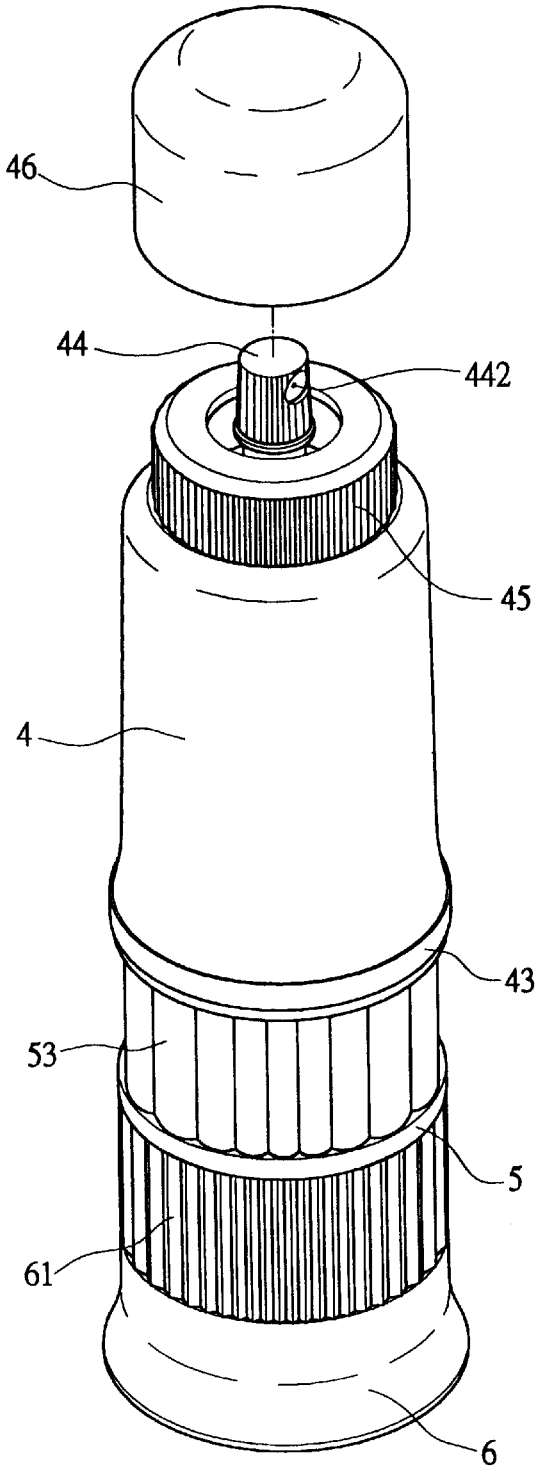
FIG.6
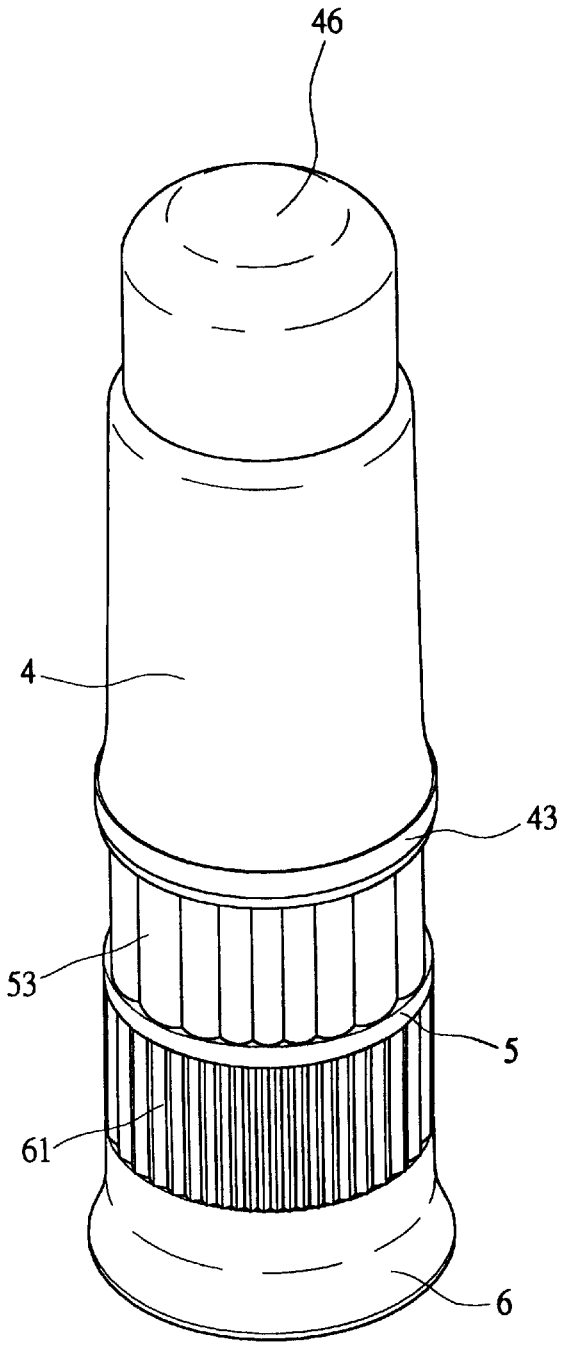
FIG.6-A

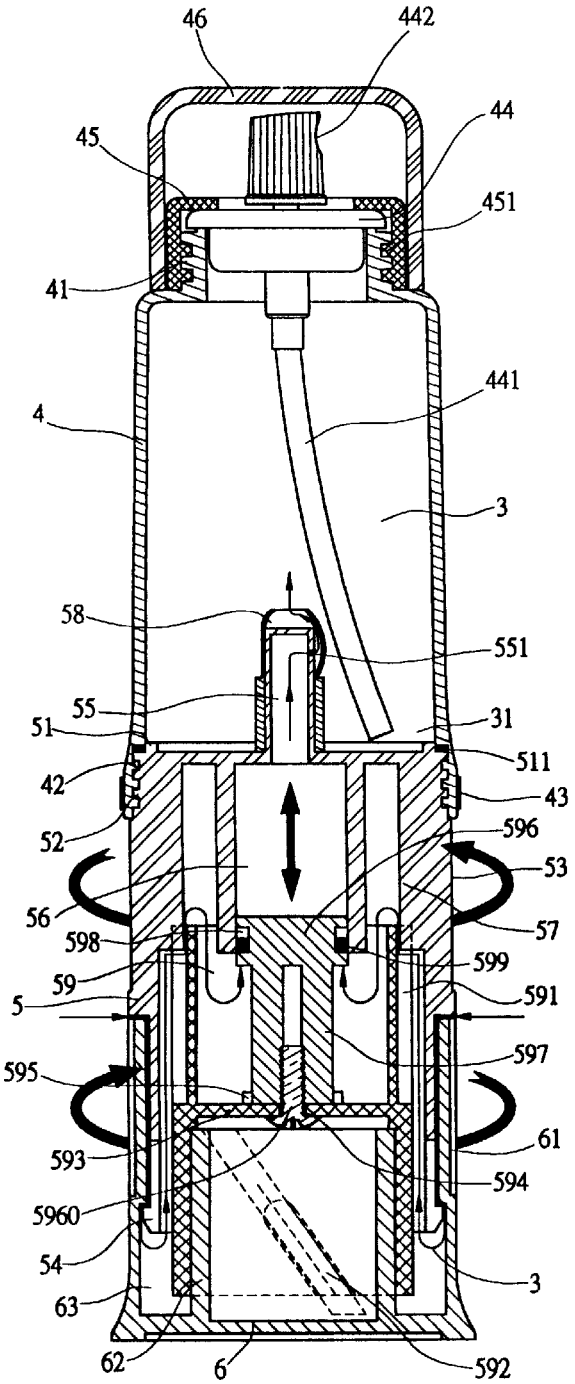
FIG.8
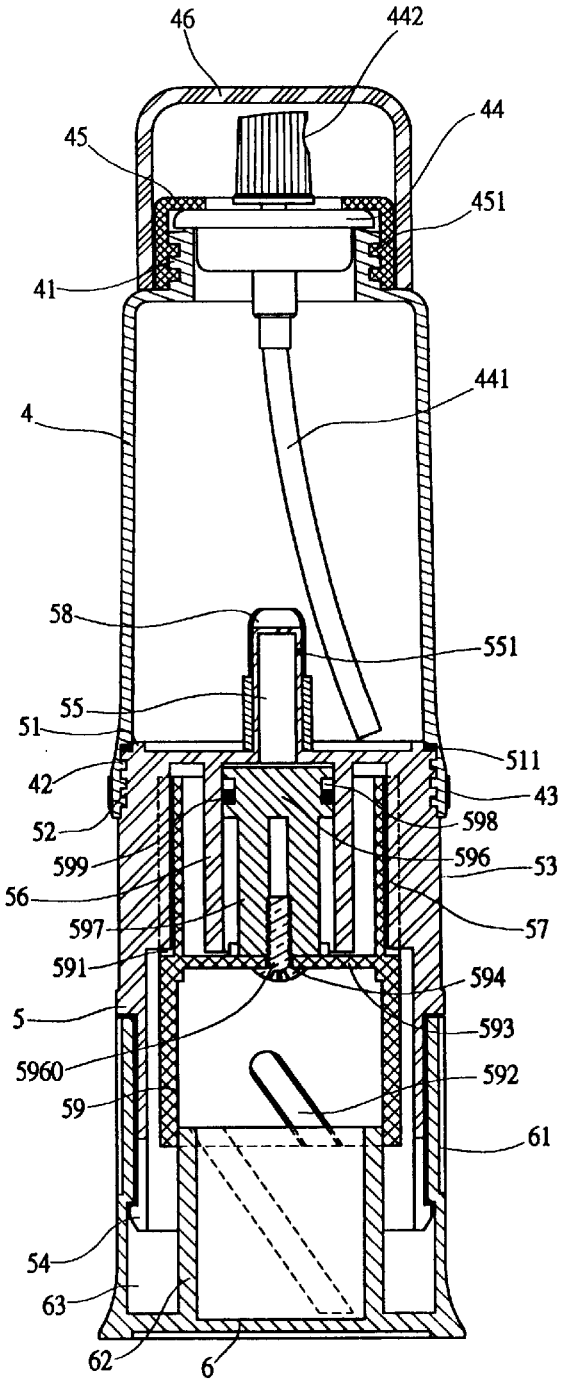
FIG.8-A

OIL CAN STRUCTURE

FIELD OF THE INVENTION

The present invention relates to an oil can structure, and especially to an oil can, wherein by rotating a rotary seat, a stud will be screwedly combined with a sliding barrel with inner thread to be moved upwards and downwards so that the inner barrel in a lower seat is driven with a small power, thus, high pressure air will be compressed into the body having oil. Therefore, the jet seat can be pressed easily to jet out oil and air.

BACKGROUND OF THE INVENTION

With reference to FIGS. 1, 2, and 3, a perspective view, an assembled cross sectional view in compressing air and after compressing air of a prior art oil can are illustrated. The prior art oil can includes a body 1, a tube 12, a seat 13, a trumpet seat 14, a small stopper 15, a larger stopper 16, a piston seat 2, a telescopic tube 25, a jetting head 26, a lock head 27. The cylindrical body 1 has an outer thread 11 at the protrusion of the upper opening. In order that the compressed air, filling air and oil can be jet out, an U shape piston seat 2 is disposed at the upper side of the body 1. A via hole 22 for receiving the telescopic tube 25 is installed atop the piston seat 2. The lateral side of the via hole is installed with a vent 23. In order that the that the aftersaid piston hat can be engaged and slides for compressing air, a concave chamber 24 is installed at the periphery of the piston seat 2. In order that the piston seat 2 can be tightly combined with the body 1 at the upper side, a pad 21 is installed therebetween. In order to control the flowing of high pressure air, a large stopper 16, a small stopper 15, and a trumpet seat 14 with via hole 141 are sequentially installed within the piston seat 2 (i. e. below the via hole 22 and vent 23). An engaging seat 13 with a via hole 132 at the center thereof and a wind portion at the lateral side 131 are installed below the trumpet seat 14. A tube 12 is installed below the engaging seat 13 with a via hole 132 at the center thereof and a wind portion at the lateral side 131. The telescopic tube 25 with a vent 252 at the center thereof is installed with a block 252 for be engaged with the jet head 26 of the jet hole 261. In order that the piston seat 2 can be fixed to the outer thread 11 atop the body 1, a lock head 27 with an inner thread 271 can be installed at the outer cover. A piston hat 28 with a block 282 having a long tube 281 is installed at the inner periphery of the U shape piston seat 2.

With reference to FIG. 2, when a high pressure air is desired to be compressed into the body 1, a long tube 281 having a block 282 below the piston hat 28 is passed through the concave seat 24 and then is pulled rapidly. As it is pushed downwards, the air 3 above the long tube 281 of the piston hat 28 will flow into the piston seat 2 through the air hole 23 to enter into the piston seat 2. The air will push away the large stopper 16 and then flows through the small stopper 15, and then flow into the body 1 with oil 31 from the via hole 141 of a trumpet seat 14 (as indicated by arrow). As the piston hat 28 is pulled upwards, air 3 will enter into the long tube 281 for pressing downwards next time.

With reference to FIG. 3, as air is compressed into the body 1, high pressure air 3 will push the large and small stoppers 15 and 16 installed between the piston seat 2 and the trumpet seat 14 upwards, the large stopper 16 will seal the air hole 23 atop the piston seat 2. Thus, high pressure air 3 can not flow out from the via hole 141 of the trumpet seat 14. Therefore, high pressure air 3 is sealed to fill fully in the body 1.

With reference to FIG. 4, a prior art device for jetting air and oil is illustrated by an assembled cross sectional view. As the oil is desired to be jetted out, the jetting head 26 must be pressed down, then the telescopic tube 25 is pressed down synchronously. Thus tube 25 with a seal lower side and a via hole 252 will enter into the piston seat 2, and then the large and small stopper 15 and 16 will press down, so that the high pressure air 3 will flow into the via hole 141 of the trumpet seat 26 to be jetted out. Then, the tube 12 at the center of the trumpet seat 14 and the seat 13 will be released with the high pressure air 3 so as to carry out the oil 31 within the body 1.

However, prior art structure has some defects. For example, each time in using, the piston hat 28 must be covered for compressing high pressure air 3 and then moves longitudinally. With the increment of the air pressure within the body 1, it becomes more and more difficult with a large power. When the oil can is used, the piston hat 28 must be pulled out to be further stored, otherwise, the jetting head 26 can not be pressed down. Moreover, the prior art piston hat 26 has not any confining structure, thus, as it is pulled out, a large traveling length will be induced so that the hat 26 falls out. Therefore, prior art structure is not a convenient design.

SUMMARY OF THE INVENTION

Accordingly, the primary object of the present invention is to provide a oil can structure comprising an upper cover, a lock head, a jetting seat, a body, a lower seat, a piston, a sliding barrel and a rotary seat. Thereby, the oil can being operated easily and conveniently with less power and labor hour. The body receiving high pressure air and oil has an outer thread and an inner thread at the upper and lower inner side thereof. The outer thread has a jetting seat with a tube. The jetting seat has a jetting hole for jetting oil and air. Moreover, a lock head is installed at an outer cover of the jetting seat; the locking head has an inner thread for being screwedly engaged with the outer thread at the upper side of the body. A lower seat with an O ring, an outer thread, and an elastic hook are installed at the body. A post with vent and enclosed by a plastic cover is installed at the center of the lower seat. An inner barrel and strips are formed at the lower inner side and lateral side thereof. A sliding barrel with a positioning groove is installed within the inner barrel. The sliding barrel is installed with a big tooth at the inner lower side thereof and has a table having a rotary seat which can be engaged with the elastic hook of the lower seat. The center thereof has a stud for being engaged with the inner thread of the sliding barrel. By bidirectional rotation of the rotary seat at the lower seat, a piston installed at the inner barrel of the lower seat slides upwards and downwards so that air will be compressed into the body to have a high pressure, therefore, as the jetting seat is pressed, oil and air will jet out together.

The various objects and advantages of the present invention will be more readily understood from the following detailed description when read in conjunction with the appended drawing.

BRIEF DESCRIPTION OF THE DRAWINGS

FIG. 6 is an exploded perspective view showing the upper cover of the present invention being uncovered.

FIG. 6A is an exploded perspective view showing that the upper cover is covered.

FIGS. 8 and 8A is an assembled cross sectional view showing that the rotary seat is rotated to push the piston upwards.

DETAILED DESCRIPTION OF THE PREFERRED EMBODIMENTS

Figure 1:
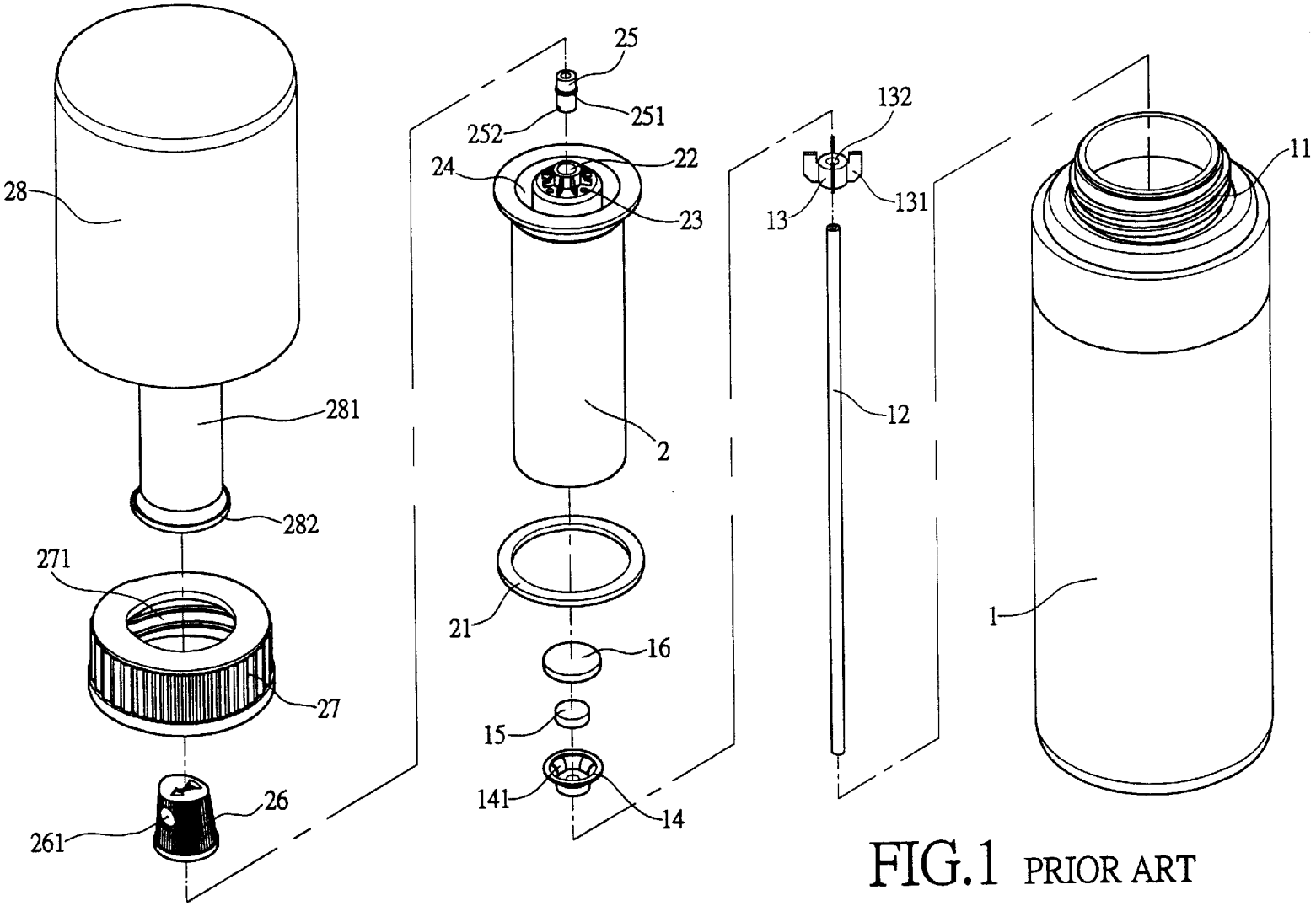
FIG.1 PRIOR ART
FIG. 1 is an exploded prior art of a prior art structure.
Figure 2:
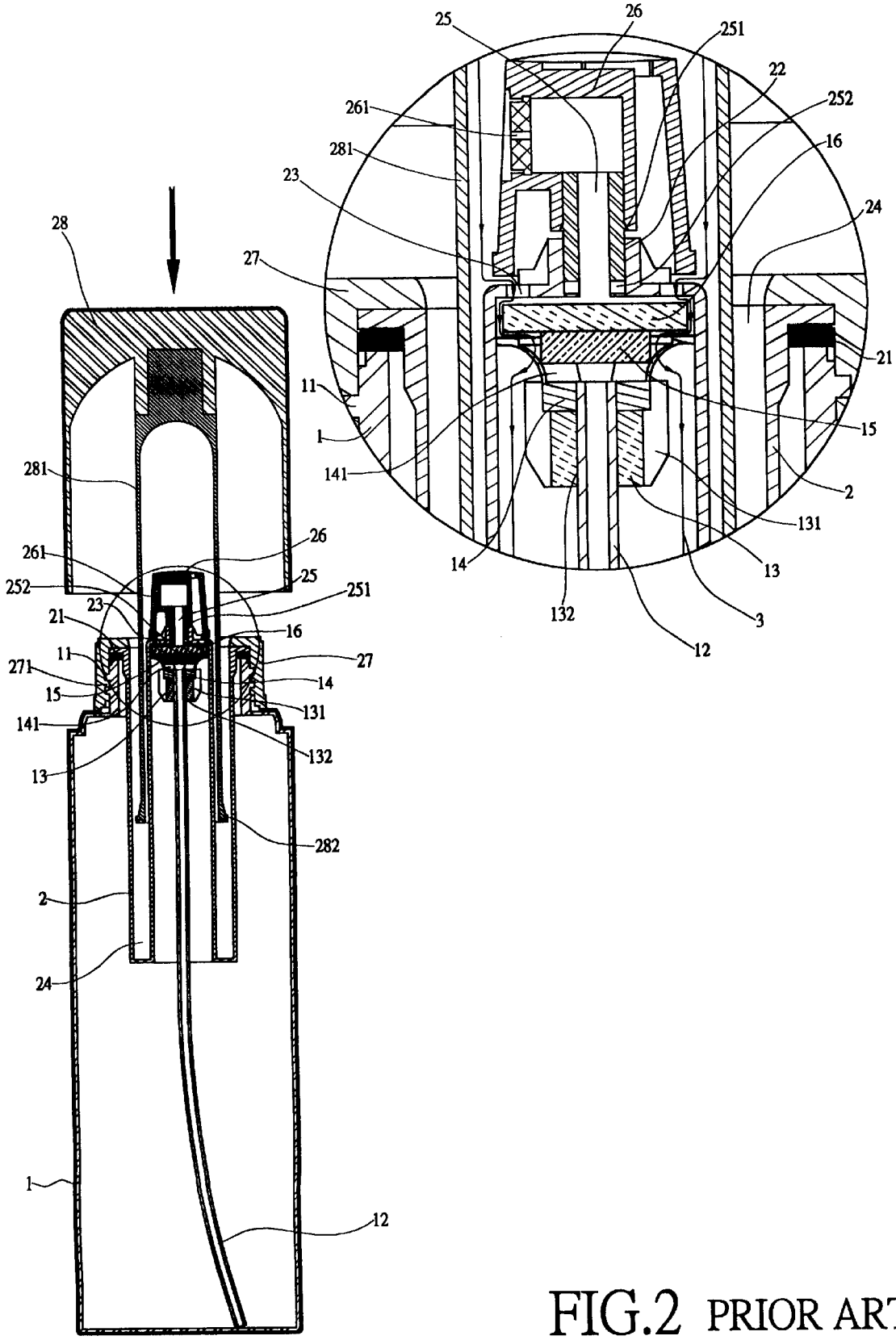
FIG.2 PRIOR ART
FIG. 2 is an assembled cross sectional view of a prior art structure in compressing air.
Figure 3:
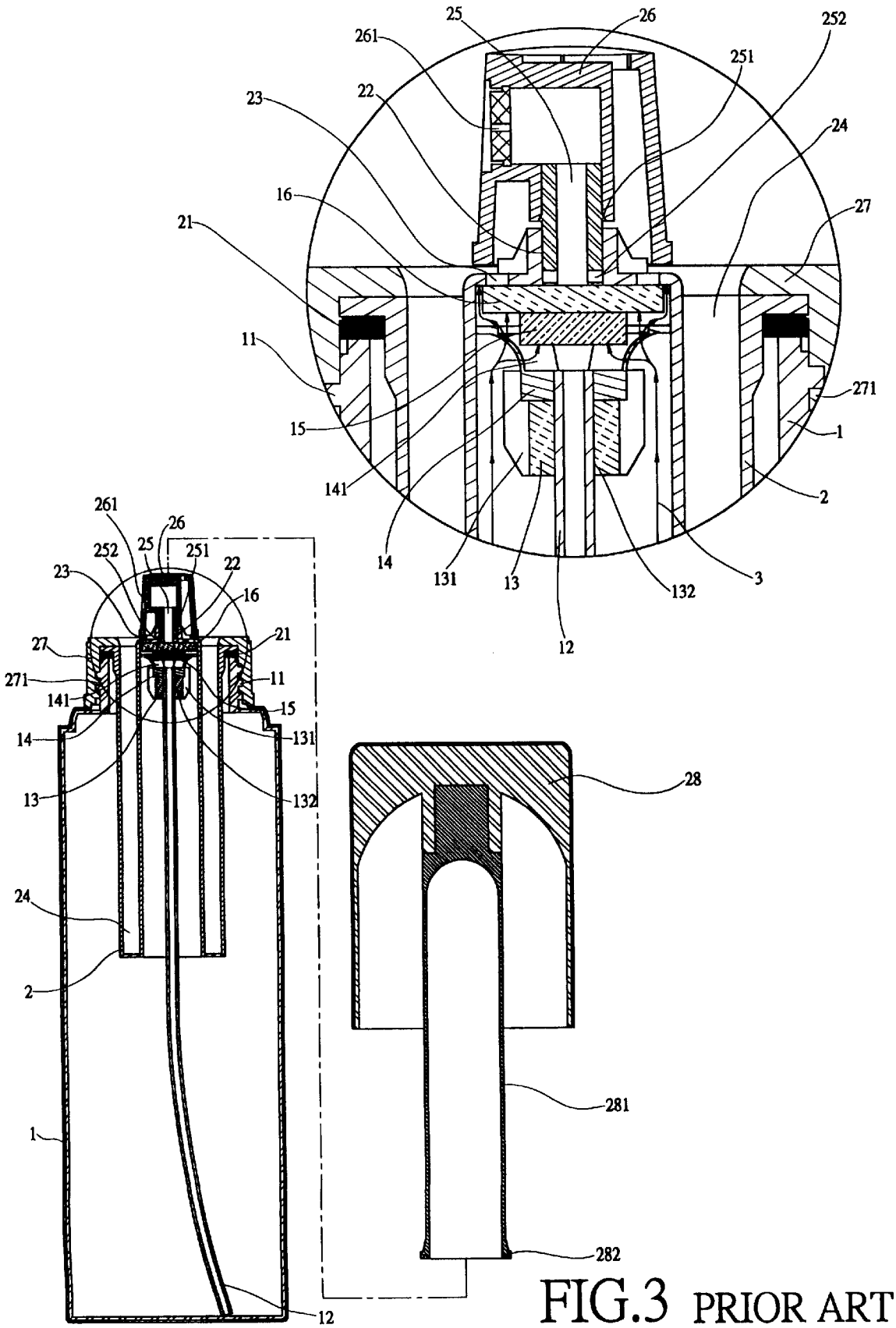
FIG.3 PRIOR ART
FIG. 3 is an assembled cross sectional view of a prior art device after compressing air without jetting oil and air.
Figure 4:
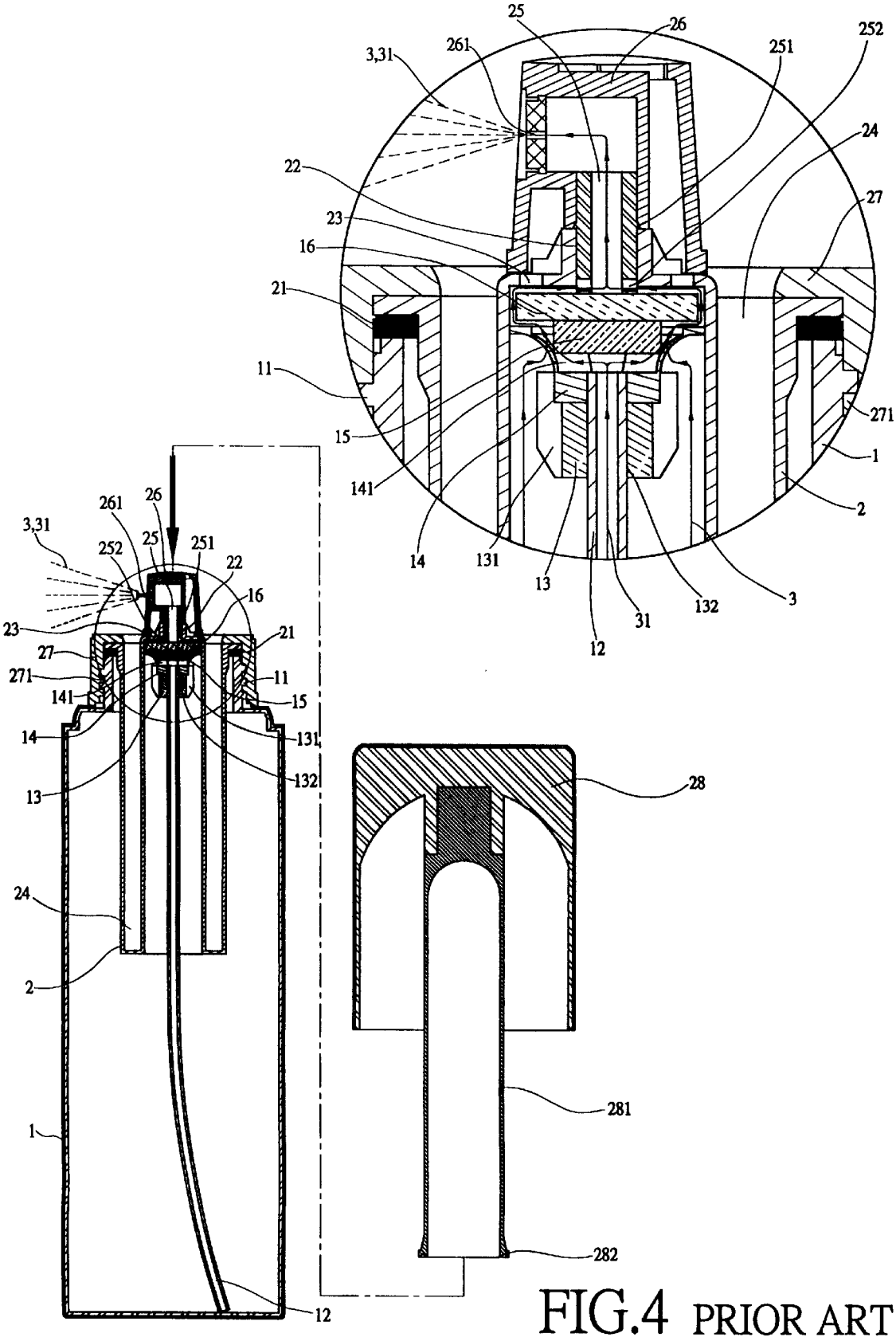
FIG.4 PRIOR ART
FIG. 4 is an assembled cross sectional view of a prior art device after compressing air with jetting oil and air.
Figure 5:
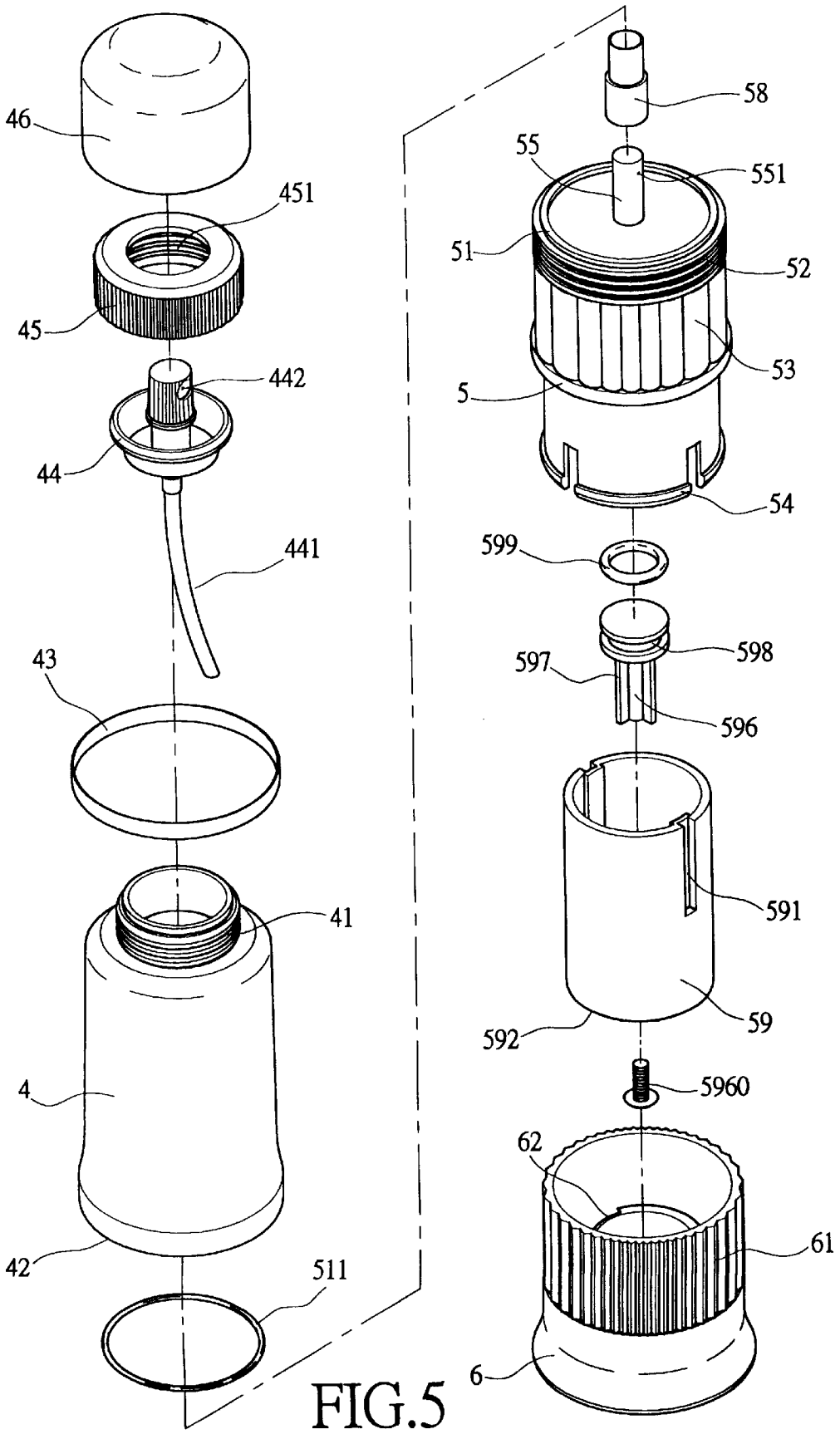
FIG. 5 is an exploded perspective view of the present invention.

With reference to FIGS. 5, 6 and 6A, the exploded and assembled perspective view of the present invention showing an uncovered and covered upper covers are illustrated. The oil can of the present invention primarily includes an upper cover 46, a lock head 45, an jet seat 44, a body 4, a lower seat 5, a piston 596, a sliding barrel 59, a rotary seat 6. The body serves to receive air 3 and oil 31 and has outer thread 41 at the upper side thereof. The inner side at the bottom thereof is formed with inner thread 42 for screwing. In order that the air 3 and oil 31 of the body 4 jet out, an jetting seat 44 with tube 441 is formed at the upper end thereof. A jetting hole 442 communicated with the tube 12 is installed on the jetting seat 44. In order that the jetting seat 44 can be firmly secured to the outer thread 41 atop the body 4, a ring lock head 45 having an inner thread 451 is installed outside the jetting seat 44. By the inner thread 451 to be screwedly locked to the outer thread 41 on the body 4, they are fixed. A further protecting upper cover 46 is installed outside the lock head 45 in order to prevent that as the jetting seat 44 is not used, it will not be pressed.

In order that air can be injected into the body 4, and then is stored in high pressure, a lower seat 5 having outer thread 52 and protrusion 51 is installed at the lower side of the body 4. A post 55 with air vent 551 is installed at the center of the lower seat 5. A ladder shape rubber cover 58 with a thin upper portion and thick lower portion encloses the post 55. The inner thread 42 of the body 4, the protrusion 51 with an O ring 511 at the lower seat 5, and the outer thread 52 are tightly screwed so as to be formed as a receiver. Other than screwing engagement, they can be combined by gluing. Ring 43 is installed at the outer periphery of the bottom of the body 4. In order that air 3 can be easily inject into the body 4, a sliding stopping portion 53 with folding for being held is installed outside the upper section of the lower seat 5, and an elastic hook 54 for being engaged with the rotary seat 6 is formed at the lower side thereof.

Figure 7:
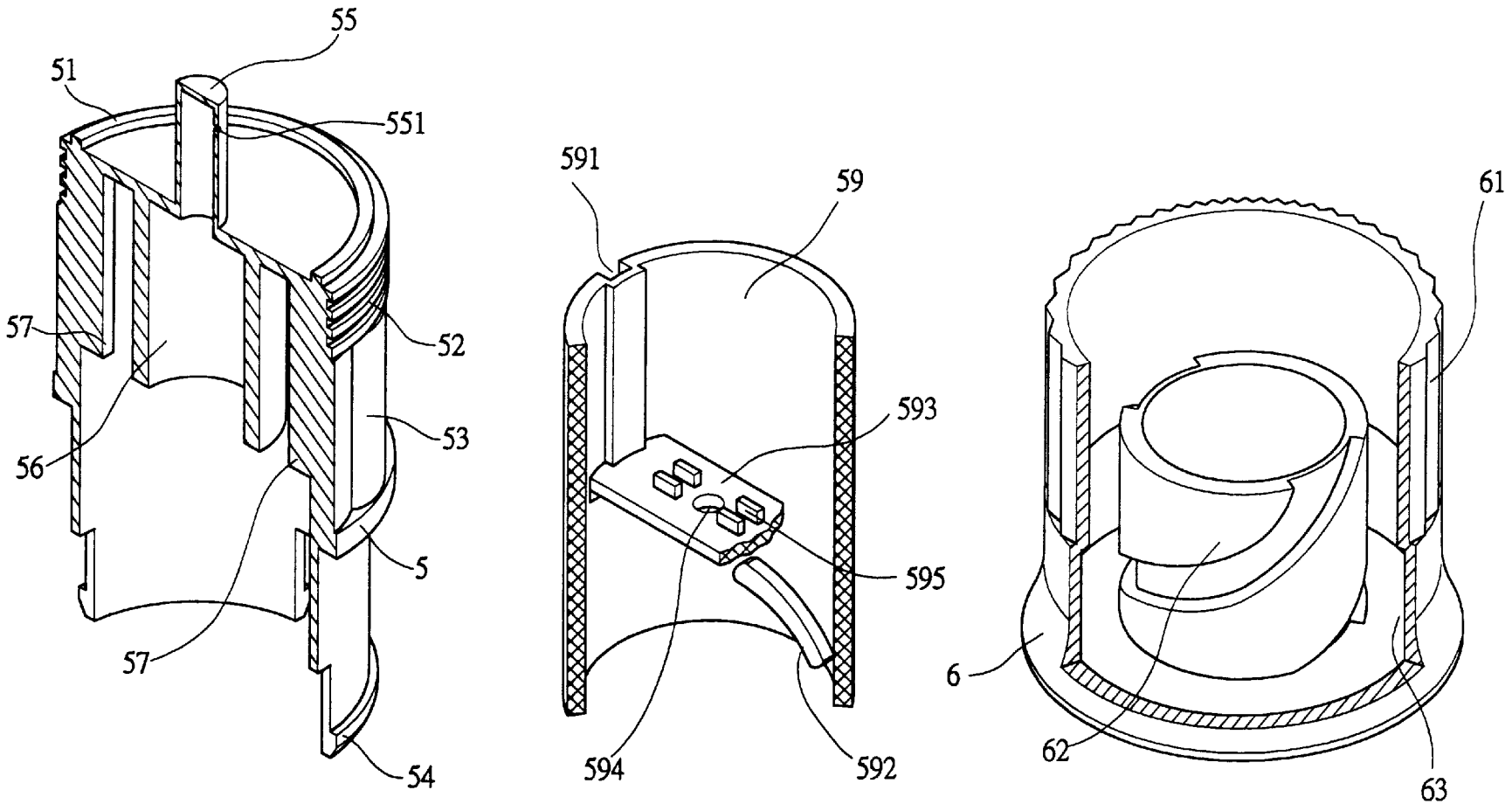
FIGS. 7A, 7B and 7C is an assembled cross sectional view showing the rotary seat of the present invention being rotated.

With reference to FIG. 7A. a perspective cross sectional view of the lower seat 5 is illustrated. An inner barrel 56 is installed at the post 55 protruded in the inner portion of the lower seat 5. Positioning strips 57 for closing or sliding the sliding barrel 59 are formed outside the inner barrel 56. Positioning grooves 591 for being engaged with the positioning strips 57 are disposed at the two sides of the sliding barrel 59. A table 593 with via hole 594 and blocks 595 are installed at the middle inner portion of the sliding barrel 59. The lower portion thereof is formed with a big inner teeth 592. The table 593 serves to position the piston 596 with a concave ring 595 at the upper section thereof by a screw 5960 to pass through the via hole 594. As it interacts with the inner barrel 56 within the lower seat 6, the piston 596 with an O ring 599 is sealed therewithin. By the piston 596 to move upwards and downwards, air 3 will be compressed. Though the air vent 551 of the post 55 enclosed by plastic cover 58, the air 3 further pushes away the plastic cover 58 so that the air 3 is pushed into the body 4 to be have a high pressure in order that the sliding barrel 9 can be operated with less labor hour and time. A rotary seat 6 with sliding stopping portion 61 is installed at an elastic hook 54 at the lower section of the lower seat 54. Since the rotary seat 6 is installed within concave portion 63 at the bottom thereof (as shown in FIG. 7C), thus, after the hook 54 is engaged, it is fixed. Therefore, the rotary seat 6 can rotate on the lower seat 5. Moreover, a sliding stopping portion 61 is installed at the outer side of the rotary seat 6. The center thereof is installed with a big stud 62 which can be screwedly locked to the big teeth 592 of the sliding barrel 59. Therefore, it can hold the sliding stopping portion 53 of the lower seat 5. As a result, the rotary seat 6 may rotate bidirectionally. Now, the big stud 62 of the rotary seat 6 will be screwedly combined with sliding barrel 59 of the big tooth 592 to slide upwards and downwards (as shown in FIGS. 7B and 7C).

With reference to FIGS. 8 and 8A, an assembled cross sectional view of the rotary seat 6 of the present invention and the assembled cross sectional view showing the upward pushing of the piston 596 of the rotary seat 6 are illustrated. That is, as air 3 is desired to be compressed into the body 4, one hand must hold the sliding stopping portion 53 of the lower seat 5, while another hand holds the rotary seat 6. Since the stud 62 at the center of the rotary seat 6 is screwedly engaged with the big teeth 592, during rotation, the sliding barrel 59 only slides upwards and downwards without rotation. Furthermore, the piston 596 with O ring 599 and installed at the table 593 of the sliding barrel 59 is sealed and engaged to the inner barrel 56 at the center of the lower seat 5. As the piston 596 moves upwards, the air 3 within the inner barrel 56 will be compressed, and then is pressed by the post 55 with air outlet 551. Then the plastic cover 58 enclosing the post 55 will be pushed away, so that the air 3 is compressed into the body 4 and thus has a high pressure (as shown in FIG. 8). When the piston 596 moves to the top and then move downwards, the plastic cover 58 will seal the air outlet 551 (as shown in FIG. 8), thus, the high pressure air 3 flowing into the body 4 will not return to the inner barrel 56. Therefore, rotating the rotary seat 6 with less power, air 3 can be pressed into the body 4. As for the air 3 in the inner barrel 56, when the piston 596 returns to the initial point at the lower side of the inner barrel 56, the air 3 can flow into the body 4 from the gap between the rotary seat 6 and the lower seat 5. In use, the upper cover 46 can be opened directly, pressing the jetting seat 44, since the pressure within the body 4 is larger than atmosphere, the high pressure air 3 filled in the body 4 is released so as to be jetted out with the oil 31. When the pressure is insufficient, it is only necessary to rotate the rotary seat 6 bidirectionally. Moreover, since the area of the piston 596 is too small, it is only displaced by threading. Thus, despite of the amount of the high pressure air 3 within the body 4, the rotation is preformed with a smaller force. As air is inputted or the can is used, no piston hat is necessary as that in the prior art. Thus, the present invention has a simple and convenient structure without inducing the problem of loss and carrying.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An oil can structure comprising an upper cover, a lock head, a jetting seat, a body, a lower seat, a piston, a sliding barrel and a rotary seat, thereby, said oil can being operated easily and conveniently with less power and labor hours, wherein said body receiving high pressure air and oil has a protrusion at an upper side thereof, and said protrusion has an outer thread; said outer thread has a jetting seat with a tube; said jetting seat has a jetting hole for jetting oil and air; moreover, a lock head is installed at an outer cover of the jetting seat; the locking head has an inner thread for being screwedly engaged with said outer thread at the upper side of said body; an upper cover is installed outside the lock head for preventing to be pressed; characterized in that:

an inner thread is installed at a lower inner side of said body, the lower seat is installed at a lower side thereof and has an outer thread, an upper side of said outer thread is installed with a concave portion with an O ring for being engaged with the inner thread of said body; a ring is further installed outside the body; a post with an air vent is installed at an upper side of the center of the lower seat having an sliding stopping portion, and said post is enclosed by a plastic cover which has an thin upper portion and an thick lower portion; an inner barrel extends in with said lower seat below said post; positioning strips are formed at the inner side of the inner barrel; a lower side of the lower seat is installed with an elastic hook; a sliding barrel having a positioning groove is installed on the positioning strip; a table having a via hole and blocks is formed at the center portion within the sliding barrel; a piston having a post is firmly secured to said inner barrel of said lower seat, an upper side of said piston is formed with a circular concave portion with an O ring, a big tooth is installed at an inner side of a lower section of the sliding barrel and is screwedly engaged with an stud of said rotary seat; by bidirectional rotation of said rotary seat at said lower seat, a piston installed at said inner barrel of said lower seat slides upwards and downwards so that air will be compressed into said body to have a high pressure, therefore, as said jetting seat is pressed, oil and air will jet out together.

* * * * *